United States Patent [19]

Tóth

[11] 4,135,916

[45] Jan. 23, 1979

[54] PROCESS IN THE MANUFACTURE OF STEELS CONTAINING NICKEL

[75] Inventor: Imré Tóth, Rambouillet, France

[73] Assignee: Societe Metallurgique le Nickel-SLN, Paris, France

[21] Appl. No.: 773,286

[22] Filed: Mar. 1, 1977

[30] Foreign Application Priority Data

Mar. 5, 1976 [FR] France ..... 76 06252

[51] Int. Cl.[2] ..... C21C 7/00; C22C 33/04

[52] U.S. Cl. ..... 75/60; 75/52; 75/130.5

[58] Field of Search ..... 75/60, 52, 130.5

[56] References Cited

U.S. PATENT DOCUMENTS

| | | | |
|---|---|---|---|
| 2,546,340 | 3/1951 | Hilty | 75/130.5 |
| 3,323,907 | 6/1967 | Kurzinski | 75/60 |
| 3,607,247 | 9/1971 | McCoy | 75/52 |

*Primary Examiner*—P. D. Rosenberg
*Attorney, Agent, or Firm*—Fleit & Jacobson

[57] ABSTRACT

The invention provides a process of producing steels containing nickel, particularly corrosion-resistant steels, which involves refining the metal bath obtained from the smelting of a ferro-nickel by adding to said metal bath in a refining converter ferro-nickel shot while concurrently contacting the metal bath with an oxygen-containing gas, e.g., a mixture of oxygen and argon, the addition of the ferro-nickel shot being carried out while controlling the flow rate of the shot in such a way that the temperature of the converter is maintained at a pre-selected level and the contacting of the oxygen-containing gas with the bath being carried out until the carbon content of the bath is reduced to a low level, e.g., about 0.04%. The inventive process permits the initial carbon and silicon levels of the metal bath to exceed 1% and 0.4%, respectively. The invention also permits the ferro-nickel shot to be added as highly refined ferro-nickel shot or as slightly refined ferro-nickel shot, or it may be added in two phases, the first utilizing slightly refined ferro-nickel shot and the second utilizing highly refined ferro-nickel shot, or both the slightly refined and highly refined ferro-nickel shot may be simultaneously added.

46 Claims, 3 Drawing Figures

PROCESS IN THE MANUFACTURE OF STEELS CONTAINING NICKEL

This invention relates to an improved process for the manufacture of steels containing nickel, and more particularly to the provision of such an improved process for the manufacture of corrosion-resistant steels.

It is known, in general, that corrosion-resistant steels essentially include iron, nickel, chromium, and occasionally cobalt (maraging steel), the best known being the so-called "18/8" steel that contains about 18% chromium and 8% nickel. Such steels are obtained by the smelting of old-iron, ferro-nickels, or other products of a nickel-containing charge of ferro-chromium, as well as recycled products originating in an earlier casting. The smelting process mixture is then transferred to a converter where it is refined by blowing oxygen or a gas mixture containing oxygen.

One of the main objects of this refining is to reduce the carbon and silicon contents of the metal bath to values under 0.5% and that may come close to 100 parts per million. This operation is highly exothermic and is difficult to perform without the simultaneous oxidation of the chromium.

At the beginning of the refining process, carbon and silicon in relatively high proportions protect the chromium against oxidation; however, at the end of the refining process, it is not easy to oxidize the carbon without oxidizing the chromium at the same time. It is necessary, therefore, to selectively control the oxidation. Two factors affect this selectivity, i.e., the temperature and the partial pressure of oxygen. As the temperature rises and/or the partial oxygen pressure drops, the oxidation becomes more selective.

The temperature at which the refining process is conducted is limited by the thermal resistance of the refractories used in the converter. Thus, the only significant factor that can be adjusted is the oxygen partial pressure.

In order to reduce this pressure, a process has been proposed which consists in refining under a vacuum. Recently, a new technique known by the English abbreviation "A.O.D.", which stands for "Argon Oxygen Decarburizing", has been described in U.S. Pat. Nos. 3,252,790 and 3,046,107, and in a paper entitled "Making Stainless Steel in the Argon-Oxygen Reactor at Joslyn", authored by J. M. Saccomano, R. J. Choulet and J. D. Ellis, which appeared in the February 1969 issue of the *Journal of Metals.* This new technique, more or less modified, makes it possible to affect the partial pressure of oxygen by diluting it in an inert gas — i.e., a gas which is neither oxidizing nor reducing toward the metallic bath of the converter - such as nitrogen, argon, or even cracked steam [Creusot Loire Uddeholm (C.L.U.) Process]. The use of this new technique makes it possible to obtain stainless steels that have very low carbon content with a "chromium yield", i.e., the ratio between the amount of chromium placed in the converter and the amount of chromium still in the metallic (unoxidized) stage at the end of the blowing process, which figure may reach and even exceed 95%.

In this new technique, the heat released by the refining operation raises the converter temperature to a value beyond the thermal resistance of the refractories. Once this value has been reached, it becomes necessary to withdraw heat from the converter or to reduce its emission. A first solution consists in increasing the inert gas content which then serves as a heat carrier. A second solution consists in the use of materials that have already been partly refined as the materials making up the charge. A third solution consists in slowing down the refining operation considerably.

The first of these solutions requires a large quantity of inert gas such as argon, and the second one requires an initial material of high cost. As for the third one, it requires very large investments, since the slowing-down of the conversion process results in the use of more converter time and consequently an increased investment for each ton of steel produced per annum.

Because of these problems, a fourth solution has been proposed, namely, cooling while adding old-iron to the metal bath during the refining process. This is done by halting the converter, introducing large amounts of old-iron, and restarting the converter.

Even though this fourth solution may be attractive at times from an economic point of view, this operation has major drawbacks including the following: (1) the addition of old-iron does not resolve the temperature regulation problem inasmuch as it causes abrupt temperature fluctuations, that is, while part of the excess heat can thus be absorbed, the old-iron addition causes sudden temperature variations; (2) the rapid and significant temperature fluctuations which are caused rapidly wear out the converter's refractory materials; (3) the handling and addition of old-iron requires skilled workers; (4) the mishandling of loading operations involving large amounts of old iron can damage the refractories because their mechanical resistance is generally low; (5) the addition of old-iron requires converter stoppages with the result that when the operation is not properly performed, the stoppages can be very long which extends the bath's time in the converter and considerably reduces the processing capacity of the converter, which then turns into a production bottleneck; and (6) the "chromium yield" as defined above drops.

The drawbacks just mentioned are such that many metallurgists prefer a solution that combines the first two solutions mentioned. In other words, as for the components of the initial load, they select materials with a relatively low carbon and/or silicon content, and they use an inert gas such as argon as a cooling agent, but this does not eliminate all the drawbacks listed above.

Accordingly, one of the objects of this invention is to provide a process for the production of steels containing nickel by means of refining them in a converter which makes it possible to avoid the aforementioned drawbacks.

Another object of the invention is the provision of a process that will make it possible to handle carbon-rich loads in the converter.

An additional object is the provision of a process that will make it possible to increase the production capacity of a facility that is already operational.

Yet another object of the invention is to provide a process that will make it possible to cool the bath of the molten metals contained in the converter.

These objects are achieved by means of a process of the foregoing type in which granulated ferro-nickel is loaded into the converter, and the flow of this scrap metal is controlled in such a way, that the converter temperature is kept at a preselected level.

Figure 1:
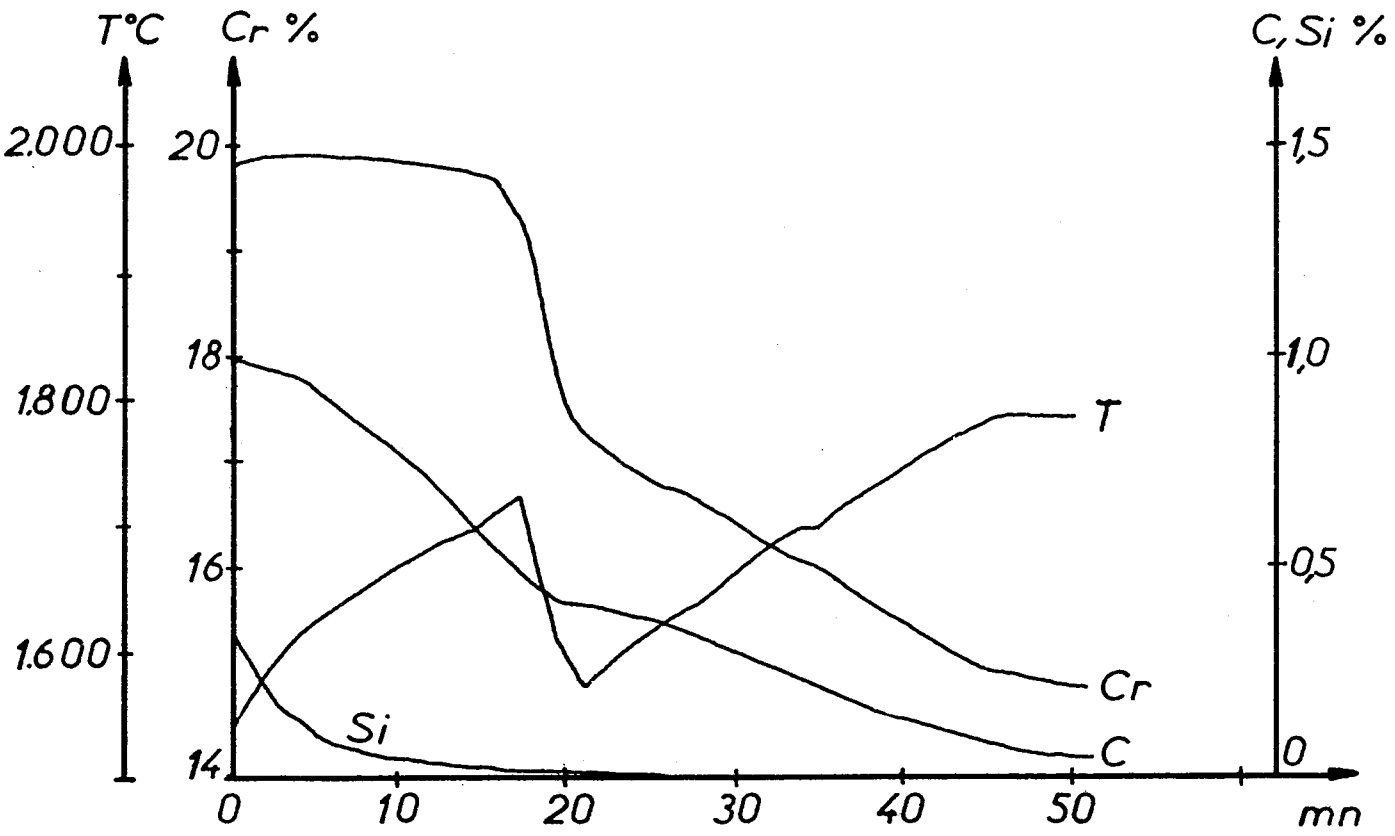
FIG. 1 is a graphical representation of the results of Example 1.

The term "ferro-nickel" as employed herein with respect to the shot which is added to the metal bath in the converter, refers to a composition containing about from 15% to 60% of nickel, about from 0% to 4% of silicon, and about from 0% to 3% of carbon, with the balance comprising iron. The ferro-nickel may also contain such additional elements as sulphur, phosphorus, chromium, cobalt, and manganese in varying amounts.

The term "converter" includes not only the conventional converters in the usual sense of the word, but also their simple technical equivalents, i.e., all devices that can be used in refining an alloy by means of blowing oxygen or any inert gas that contains oxygen, which includes argon, helium, krypton, xenon, nitrogen and hydrogen. Any mixture of oxygen and the inert gas may be used. The gas flow rate per metric ton of metal bath generally ranges between $0.2m^3$ and $1.5m^3$ per minute.

The bath of molten metals before refining, contained in the converter and to which the ferro-nickel is added, has the following general composition:

carbon: 0.06% to 3%
sulphur: 0.03% to 0.12%
silicon: 0.1% to 1%
chromium: 4% to 40%
nickel: 0% to 25%
manganese: 0.1% to 2%
iron: balance.

The value chosen for the temperature obviously depends on the refractory materials used. The only rule to be followed is that the temperature has to be as high as is compatible with good care of the refractories. Preferably the temperature ranges from 1500° C. to 2500° C. The blowing of the oxygen-containing gas commences after the metal bath has reached a predetermined minimum temperature within the range of 1500° C.–1600° C.

All types of shots of ferro-nickel may be used in the method of the present invention. But, for reasons of storage and of handling, it is preferable that the shape of the shots be as close as possible to a sphere. As far as size is concerned, the size may preferably range from 1 mm to about 5 centimeters in diameter. The shots are formed by a granulation technique.

The composition of the ferro-nickels used may vary, but, as will be shown below, it may be significant. For example, it is possible to use highly-refined and slightly-refined ferro-nickels manufactured by Societe' Metallurgique LeNickel - SLN and sold under the trademanes "FNI" and "FNC", respectively. "FNI" has the general composition:

nickel - a minimum of 20%
carbon - a maximum of 0.040%
silicon - a maximum of 0.040%
sulphur - a maximum of 0.040%
phosphorus - a maximum of 0.020% of which a typical example is the following:

nickel - 24–30%
carbon - 0.030%
silicon - 0.030%
sulphur - 0.030%
phosphorus - 0.016%
chromium - 0.030%
cobalt - 1/30 of Ni content
iron - balance.

"FNI" has an apparent relative density of 5, a real relative density of 8, and a melting point of 1470° C. (2680° F.). "FNC" has the general composition:

nickel - a minimum of 20%
sulphur - a maximum of 0.100%
phosphorus - a maximum of 0.020% of which a typical example is the following:

nickel - 22–28%
carbon - 1.20–1.80%
silicon - 0.50–2.50%
sulphur - 0.060%
phosphorus - 0.016%
chromium - 1.20–1.80%
cobalt - 1/30 of Ni content
iron - balance.

"FNC" has an apparent relative density of 5, a real relative density of 7.7 and a melting point of 1310° C. (2390° F.).

The addition of the shot may be accomplished as a continuous operation, e.g., by means of a feed-hopper controlled by the coverter's temperature. Because of the ease of handling the shot, and because of its capability of being poured easily, the flow-rate of the shot can be accurately controlled and, consequently, temperature control is excellent and no change in the converter's operations is required. That is, when the oxygen-containing gas is blown into the metal bath in the converter, an exothermic reaction occurs with evolution of heat. The temperature is controlled and maintained at a value chosen within the range of 1500° C. to 2500° C. by the addition of the ferro-nickel which absorbs the evolved heat.

Accordingly, the process of the present invention solves the problem of the regulation of the temperature and of the absorption of the heat released by the refining process with none of the drawbacks of the four proposed solutions listed above. Particularly, the carbon and silicon content of the load can be much higher than in previous proposals. This results in lower costs of the components of the charge which, in this case, do not require refinement.

At this point, it should be noted that a high proportion of carbon and silicon protects the chromium from oxidation during the period when the temperature in the converter is lower than the optimal refining temperature, and for that reason, it enhances the chromium yield as defined above.

Another benefit of the process of this invention is that it can considerably increase the production capacity of existing facilities or, in the case of future plants, it can reduce investments on a per ton per annum basis. In particular, the production capacity of systems combining an electric furnace, e.g., ferro-nickels, increases the treatment capacity of the system in the same proportion inasmuch as the energy made available in this way within the electric furnace can then be used to smelt a larger quantity of the other components of the stainless steel. In addition, with the electric power remaining constant with an increased production, electrical consumption per ton of steel produced decreases as the capacity increases.

The composition of the added ferro-nickel has a strong effect on the increase in capacity. Thus, if the ferro-nickel is "highly refined", such as the previously-mentioned "FNI", and contains little carbon, the "chromium yield" is satisfactory, but the increase in production capacity is relatively small because the fuel, e.g., the carbon and possibly the silicon, is added in small amounts.

On the other hand, if a ferro-nickel that is "slightly refined" is added, such as the previously-mentioned "FNC", the capacity increase is very significant while the "chromium yield" as defined above remains satisfactory.

A good technique of adding ferro-nickels comprises adding slightly refined shot of ferro-nickel at the outset and highly refined shot of ferro-nickel at the end.

However, it is generally preferable that in adding the ferro-nickel not to increase the carbon content of the bath too much.

One of the most attractive features of the present invention is, contrary to prior art techniques, to start with a bath with relatively high carbon and silicon content, i.e., with a bath in which the carbon and silicon levels are higher than 1% and 0.4%, respectively, and adding thereto, in a continuous manner, a ferro-nickel that is relatively slightly refined, such as the aforementioned "FNC", and in ending up, possibly with the addition of a more highly refined produce, such as the aforementioned "FNI". The quantity of ferro-nickel added to the bath may comprise about from 1% to 20% by weight. Decarbonization usually takes place within ¼ to 2 hours.

Another way of carrying out the method of the invention involves the simultaneous addition of slightly and highly refined ferro-nickels, while adjusting their respective flows in such a way that the over-all carbon content of the added ferro-nickel is practically equal to the carbon content of the bath during treatment.

The production capacity increase and the power savings achieved by means of the present invention may reach 10% and even exceed 20%.

From the above, specialists in the field will easily perceive the economic attractiveness of the invention, inasmuch as they will observe several percentage points in the cost of refining.

The following examples are not intended to limit the invention but to provide an illustration of how the invention may be practiced. They show, particularly, that adding ferro-nickel in accordance with the present invention offers a very significant improvement over the prior art.

Figure 2:
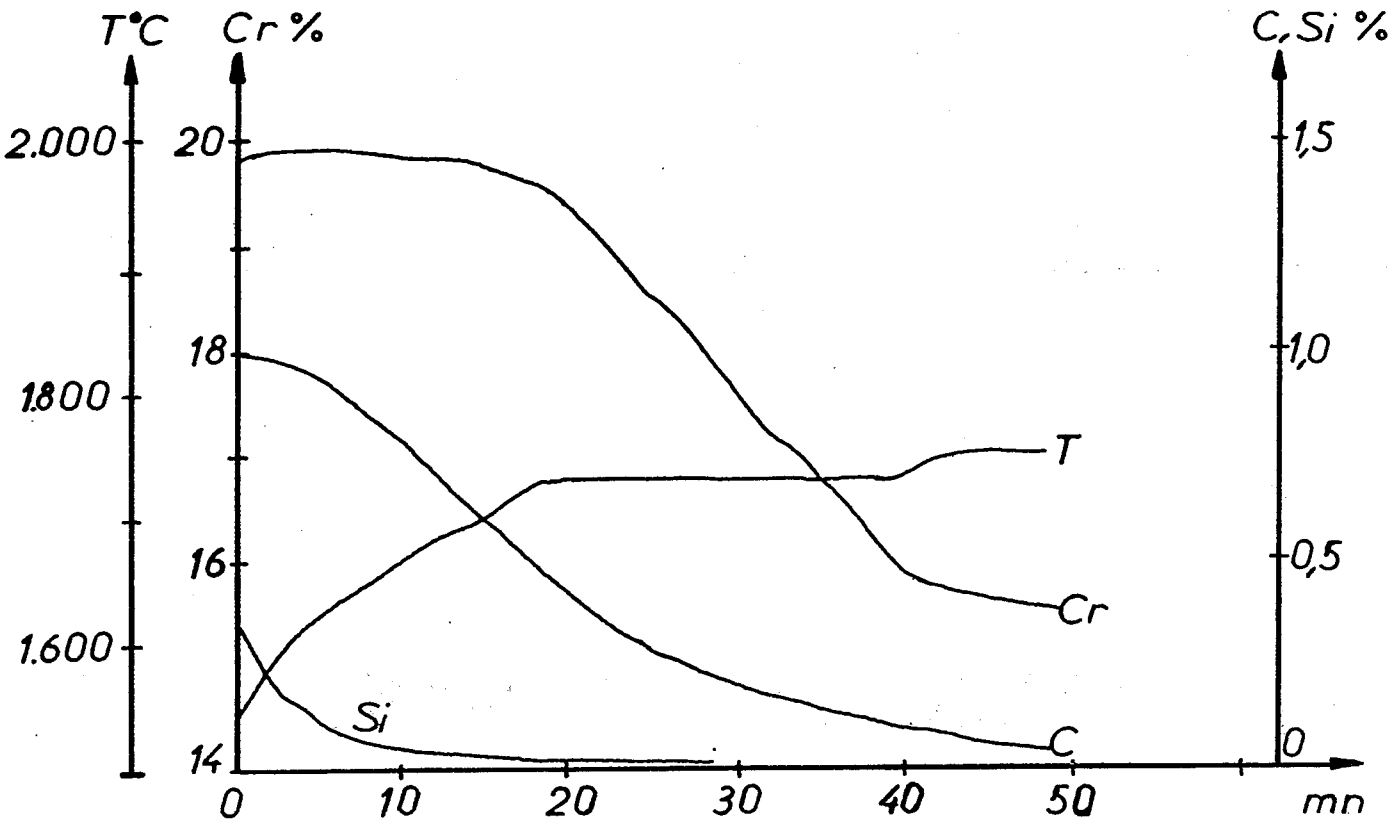
FIG. 2 is a graphical representation of the results of Example 2.
Figure 3:
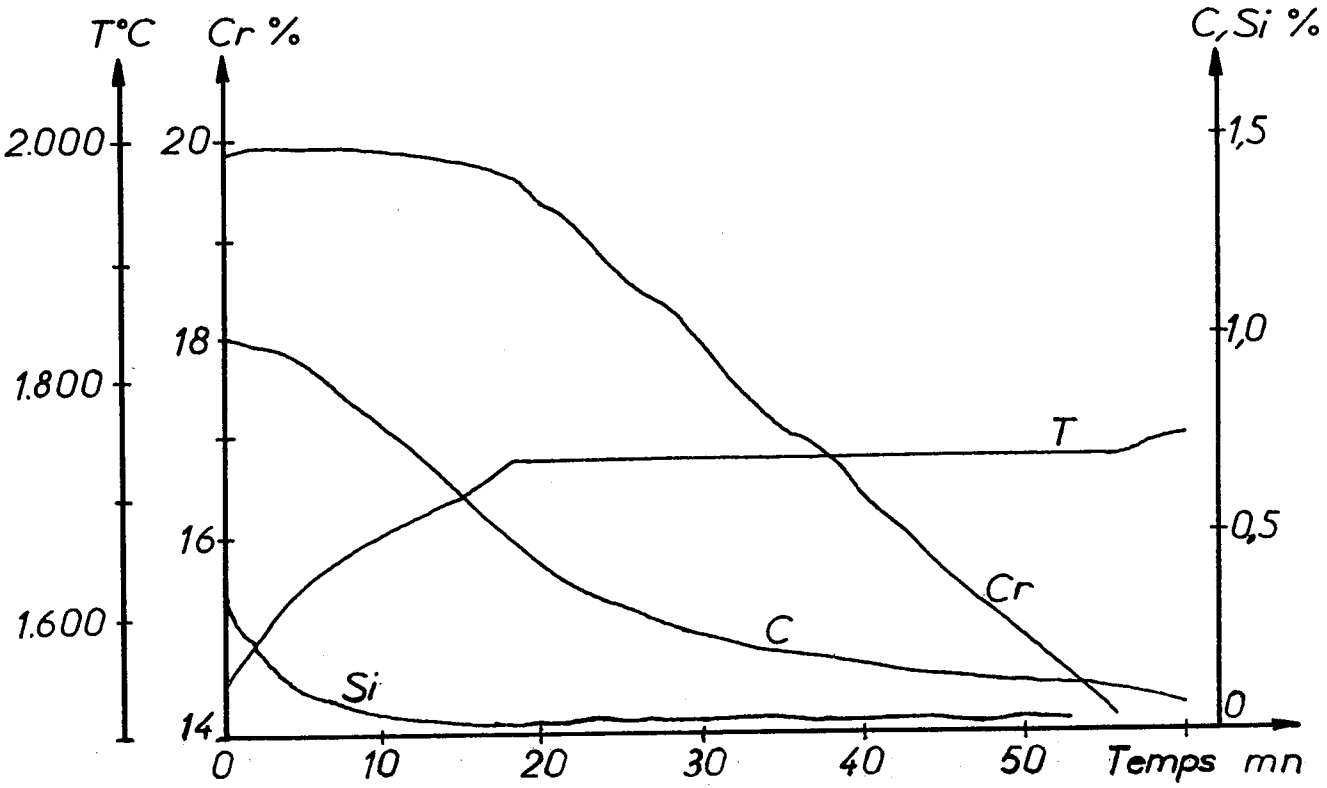
FIG. 3 is a graphical representation of the results of Example 3.

These examples should be read in conjunction with the accompanying drawings, in which FIGS. 1, 2 and 3 represent as functions of time changes in the temperature and in the chromium, carbon, and silicon levels of the metal bath. The notation "temps mn" on the abscissa of each of the figures means that the time is given in minutes. It should be noted that these curves are for general information only and, in particular, do not make it possible to immediately calculate the chromium yield at the time of operation inasmuch as they do not take the mass and composition of the slag into consideration.

In all the following examples, the composition by weight of the metal bath in the converter before refining is as follows:

Carbon 1%
Sulfur 0.04%
Silicon 0.35%
Chromium 19.75%
Nickel 7.5%
Manganese 0.75%
Iron Balance At the time of refining, the flow-rate of gas injected into the metal bath is equal to $0.78^3$ per ton per minute. The composition of this gas corresponding to the carbon content is indicated in the following table:

| Carbon content of the bath during the refining process (percentage by weight) | Input ratio by volume of oxygen to argon |
|---|---|
| from 1 to 0.25 | 3/1 |
| from 0.25 to 0.10 | 2/1 |
| from 0.10 to 0.04 | 1/3 |

The input ratio relates to the composition of the flowed gas and is the ratio between the quantity of oxygen and the quantity of argon expressed in moles or in volume.

The "chromium yield" as defined below is computed on the assumption that the blowing of the gas is stopped when the carbon content reaches 0.04%.

EXAMPLE 1

Addition of the Ferro-Nickel in the Form of Ingots and in a Non-Continuous Manner In this example, refining is halted when the temperature of the metal bath in the converter reaches 1720° C., so that ferro-nickel can be added as ingot, to the extent of 10% by weight of the mass of the bath. The ferro-nickel used is the kind that is sold under the trade name "FNI", and its composition by weight is as follows:

Nickel 24%
Carbon 0.030%
Silicon 0.030%
Sulfur 0.030%
Phosphorus 0.016%
Chromium 0.030%
Cobalt 0.8%
Iron Balance When this addition of ferro-nickel is completed, blowing of the gas is resumed and later halted — as explained above — when the carbon content of the bath is 0.04%.

The curves of FIG. 1 show as time functions, the temperature of the bath (Curve T) expressed in centigrade, as well as the chromium, carbon and silicon (Curves Cr, C, and Si, respectively) content of the bath expressed in percentages by weight. These curves show a considerable discontinuity when the ferro-nickel is added.

As far as the "chromium yield", as defined above, is concerned, it reaches 80.3%.

This example utilizes the addition of ferro-nickel in ingot form in a non-continuous manner and illustrates the drawbacks which occur when the ferro-nickel is added in a form other than as shot and in a non-continuous manner.

EXAMPLE 2

Continuous Addition of the Ferro-Nickel in the Form of Shot

This example differs from the previous one by the fact that the ferro-nickel "FNI" is fed into the converter in the form of shot and in a continuous manner, i.e., without any halt of the refining process. In all other respects, the composition of the metal bath and of the ferro-nickel are the same as in Example 1, above, as is the process of operation as a whole.

The curves of FIG. 2, which reflect these operations, have been plotted in the same way as those of FIG. 1. The absence of any discontinuity is observed which is a favorable factor as stated above. Here, the "chromium yield" reached 83% and this is a definite improvement when compared to the case of Example 1.

EXAMPLE 3

Continuous Addition in the Form of Shot

In this example, which corresponds to FIG. 3, a mass of ferro-nickel shot is added to the metal bath in a continuous manner as in Example 2. This mass corresponds to 18% by weight of the mass of the bath, and this is the maximum amount that can be added under these conditions.

The ferro-nickel shot used is generally of the quality sold under the tradename of "FNC". Its composition by weight is as follows:

Carbon 1.6%
Silicon 1.5%
Sulfur 0.06%
Phosphorus 0.01%
Chromium 1.45%
Nickel 24.13%
Cobalt 0.8%
Iron Balance In this case, the "chromium yield" is 77.5%. This example shows that the use of slightly refined ferro-nickel is primarily reflected in an increase of the amount of ferro-nickel that may be fed into the converter. The slight reduction of the "chromium yield" observed in this example, can easily be corrected, and even improved by controlling the blowing conditions (see the following example).

EXAMPLE 4

Changes in Blowing Conditions

This example differs from the blowing conditions used in Examples 1–3. The blowing conditions used in this example as a function of the carbon content are shown in the following table as follows:

| Carbon content of the bath in the course of the refining process (percentage by weight) | Input ratio by volume of oxygen to argon |
|---|---|
| from 1 to 0.35 | 3/1 |
| from 0.35 to 0.25 | 1/1 |
| from 0.25 to 0.04 | 1/3 |

These changes result in a reduction of the amount of ferro-nickel added which is substantially of the grade sold under the tradename of "FNC", the composition of which is given in Example 3. The quantity added amounts to 9% by weight in relation to the initial mass of the bath.

The "chromium yield" reached 85.7%.

The examples given above are concerned with all "Argon Oxygen Decarburizing" processes. But, in a general way, the invention may easily be used in all processes of highly exothermic refining.

The preceding examples will show those working in the field the possibilities that have been opened up for them by the present invention. In accordance therewith, they will be able to select the operating conditions best suited to each individual case.

We claim:

1. In the process for the manufacture of a steel containing nickel, chromium, silicon, iron, and carbon through the refining of a metal bath containing the aforesaid elements in a converter by the addition of a solid material thereto to control the temperature and thereby obtain a steel having an increased chromium yield as well as a savings in energy, the improvement which comprises continuously adding solid ferro-nickel shot containing carbon and silicon in amounts not exceeding about 3% and about 4%, respectively, and in the form of roughly spherical granules each of which is of a size ranging about from 1 millimeter to 5 centimeters in diameter into the converter at a controlled flow rate to maintain the temperature of the converter at a pre-selected level below the thermal resistance of the converter's refractories, while concurrently contacting the metal bath with an oxygen-containing gas.

2. The process of claim 1 wherein the initial carbon and silicon levels of the metal bath are higher than 1% and 0.4%, respectively.

3. The process of claim 1 wherein the added ferro-nickel shot comprises highly refined shot the carbon content of which is, at most, equal to the carbon content of the metal bath after the refining process has been completed.

4. The process of claim 2 wherein the added ferro-nickel shot comprises highly refined shot the carbon content of which is, at most, equal to the carbon content of the metal bath after the refining process has been completed.

5. The process of claim 1 wherein the ferro-nickel shot comprises slightly refined shot, the silicon content of which is, at least, equal to 0.4% by weight.

6. The process of claim 2 wherein the ferro-nickel shot comprises slightly refined shot, the silicon content of which is, at least, equal to 0.4% by weight.

7. The process of claim 1 wherein the ferro-nickel shot added to the converter is, in a first phase, slightly refined ferro-nickel shot, and in a second phase, highly refined ferro-nickel shot.

8. The process of claim 2 wherein the ferro-nickel shot added to the converter is, in a first phase, slightly refined ferro-nickel shot, and in a second phase, highly refined ferro-nickel shot.

9. The process of claim 3 wherein the ferro-nickel shot added to the converter is, in a first phase, slightly refined ferro-nickel shot, and in a second phase, highly refined ferro-nickel shot.

10. The process of claim 4 wherein the ferro-nickel shot added to the converter is, in a first phase, slightly refined ferro-nickel shot, and in a second phase, highly refined ferro-nickel shot.

11. The process of claim 5 wherein the ferro-nickel shot added to the converter is, in a first phase, slightly refined ferro-nickel shot, and in a second phase, highly refined ferro-nickel shot.

12. The process of claim 6 wherein the ferro-nickel shot added to the converter is, in a first phase, slightly refined ferro-nickel shot, and in a second phase, highly refined ferro-nickel shot.

13. The process of claim 1 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

14. The process of claim 2 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

15. The process of claim 3 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

16. The process of claim 4 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

17. The process of claim 5 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

18. The process of claim 6 wherein slightly and highly refined ferro-nickel shot are simultaneously added to the converter while their respective flow rates are controlled in such a way that the mean carbon content of the ferro-nickel added will always be essentially equal to the carbon content of the bath at the time of its addition.

19. A process for manufacturing a corrosion-resistant steel containing nickel, chromium, silicon, iron, and carbon, comprising smelting a ferro-nickel containing the aforesaid elements to form a metal bath, transferring the metal bath to a refining converter, and refining the metal bath by continuously adding thereto solid ferro-nickel shot in the form of roughly spherical granules each of which is of a size ranging about from 1 millimeter to 5 centimeters in diameter and comprising carbon and silicon in amounts not exceeding about 3% and about 4%, respectively, nickel, chromium, sulphur, phosphorus, and iron while concurrently contacting the metal bath with an oxygen-containing gas, said addition of the ferro-nickel shot being carried out at a controlled rate so as to maintain the exothermic temperature produced to a preselected level below the thermal resistance of the converter's refractories, and said contacting of the metal bath with the oxygen-containing gas being continued until the carbon content of the bath has been reduced to about 0.04%.

20. The process of claim 19 wherein the composition of the metal bath, before refining, comprises, in percent by weight:

carbon - 0.06% to 3%
sulphur - 0.03% to 0.12%
silicon - 0.1% to 1%
chromium - 4% to 40%
nickel - 0% to 25%
manganese - 0.1% to 2%
iron - balance

21. The process of claim 19 wherein the composition of the metal bath, before refining, comprises in percent by weight:

carbon - 1.00%
sulphur - 0.04%
silicon - 0.35%
chromium - 19.75%
nickel - 7.50%
manganese - 0.75%
iron - balance

22. The process of claim 19 wherein the initial carbon and silicon levels of the metal bath before refining exceed 1% to 0.4%, respectively.

23. The process of claim 19 wherein the added ferro-nickel shot consists of highly refined shot, the carbon content of which, is, at most, equal to the carbon content of the metal bath after the refining is completed.

24. The process of claim 23 wherein the composition of the added highly refined ferro-nickel shot comprises, in percent by weight:

nickel - a minimum of 20%
carbon - a maximum of 0.040%
silicon - a maximum of 0.040%
sulphur - a maximum of 0.040%
phosphorus - a maximum of 0.020%

25. The process of claim 23 wherein the composition of the added highly-refined ferro-nickel shot comprises, in percent by weight:

nickel - 24% to 30%
carbon - 0.030%
silicon - 0.030%
sulphur - 0.030%
phosphorus - 0.016%
chromium - 0.030%
cobalt - ⅓ of the nickel content
iron - balance

26. The process of claim 23 wherein the composition of the added highly-refined ferro-nickel shot comprises, in percent by weight:

nickel - 24.000%
carbon - 0.030%
silicon - 0.030%
sulphur - 0.030%
phosphorus - 0.016%
chromium - 0.030% cobalt - 0.800%
iron - balance

27. The process of claim 19 wherein the added ferro-nickel shot consists of slightly refined shot, the silicon content of which is, at least, equal to 0.4% by weight.

28. The process of claim 27 wherein the composition of the added slightly refined ferro-nickel shot comprises, in percent by weight:

nickel - a minimum of 20%
sulphur - a maximum of 0.100%
phosphorus - a maximum of 0.020%

29. The process of claim 27 wherein the composition of the added slightly refined ferro-nickel shot comprises, in percent by weight:

nickel - 22% to 28%
carbon - 1.20% to 1.80%
silicon - 0.50% to 2.50%
sulphur - 0.060%
phosphorus - 0.016%
chromium - 1.20% to 1.80%
cobalt - 1/30 of the nickel content
iron - balance 30. The process of claim 27 wherein the composition of the added slightly refined ferro-nickel shot comprises, in percent by weight:

nickel - 24.13%
carbon - 1.60%
silicon - 1.50%
sulphur - 0.06%
phosphorus - 0.01%
chromium - 1.45%
cobalt - 0.80%
iron - balance 31. The process of claim 19 wherein the added ferro-nickel shot is added in two phases, the first phase utilizing slightly refined ferro-nickel shot having the composition comprising, in percent by weight:

nickel - 22% to 28%
carbon - 1.20% to 1.80%
silicon - 0.50% to 2.50%
sulphur - 0.060%
phosphorus - 0.016%
chromium - 1.20% to 1.80%
cobalt - 1/30 of the nickel content
iron - balance and the second phase utilizing highly refined ferro-nickel shot having the composition comprising, in percent by weight:

nickel - 24% to 30%
carbon - 0.030%
silicon - 0.030%
sulphur - 0.030%
phosphorus - 0.160%
chromium - 0.030%
cobalt - ⅓ of the nickel content
iron - balance 32. The process of claim 19 wherein the added ferro-nickel shot consists of slightly refined ferro-nickel shot having the composition, in percent by weight:

nickel - 22% to 28%
carbon - 1.20% to 1.80%
silicon - 0.50% to 2.50%
sulphur - 0.060%
phosphorus - 0.016%
chromium - 1.20% to 1.80%
cobalt - 1/30 of the nickel content
iron - balance and highly refined ferro-nickel shot having the composition comprising, in percent by weight:

nickel - 24% to 30%
carbon - 0.030%
silicon - 0.030%
sulphur - 0.030%
phosphorus - 0.016%
chromium - 0.030%
cobalt - ⅓ of the nickel content
iron - balance which are simultaneously added while the respective flow rates are controlled in such a way that the mean carbon content of the ferro-nickel added will always be essentially equal to the carbon content of the bath at the time of its addition.

33. The process of claim 19 wherein the quantity of the ferro-nickel shot added to the metal bath ranges from about 1% to 20% by weight.

34. The process of claim 19 wherein the oxygen-containing gas is a mixture of oxygen and a gas selected from the group consisting of argon, helium, krypton, neon, xenon, nitrogen, and hydrogen.

35. The process of claim 19 wherein the oxygen-containing gas is a mixture of oxygen and argon.

36. The process of claim 35 wherein the oxygen-containing gas is a mixture of oxygen and argon in any proportion.

37. The process of claim 19 wherein the metal bath is contacted by the oxygen-containing gas flowing at a rate ranging about from 0.2 $m^3$ to 1.5 $m^3$ per minute per metric ton of the metal bath.

38. The process of claim 19 wherein the exothermic temperature produced and maintained ranges from about 1500° C. to 2500° C.

39. The process of claim 19 wherein the blowing of the metal bath with the oxygen-containing gas commences when the metal bath has reached a predetermined temperature ranging between about 1500° C. and 1600° C.

40. The process of claim 19 wherein the decarburization of the metal bath occurs within ¼ hour to 2 hours.

41. The process of claim 19 wherein the composition of the metal bath, before refining, comprises, in percent by weight:

carbon - 1.00%
sulphur - 0.04%
silicon - 0.35%
chromium - 19.75%
nickel - 7.50%
manganese - 0.75%
iron - balance, the oxygen-containing gas is a mixture of oxygen and argon, and, at the time of refining, the flow rate of the oxygen-containing gas is $0.78^3$ per minute per metric ton.

42. The steel produced by the process of claim 1.

43. The steel produced by the process of claim 19.

44. The steel produced by the process of claim 26.

45. The steel produced by the process of claim 30.

46. The steel produced by the process of claim 41.

* * * * *